US006047703A

United States Patent [19]

Paglericcio et al.

[11] Patent Number: 6,047,703

[45] Date of Patent: Apr. 11, 2000

[54] FLUID DISPENSING DEVICE

[76] Inventors: Fernando Paul Paglericcio, P.O. Box 272, Russell, Ontario, Canada, K4R 1E1; Chester F. Girard, 24 Martel Street, Aylmer, Quebec, Canada, J9H 1S5

[21] Appl. No.: 09/286,451

[22] Filed: Apr. 6, 1999

[30] Foreign Application Priority Data

Apr. 7, 1998 [CA] Canada ..... 2,234,295

[51] Int. Cl.[7] ..... A45D 24/22

[52] U.S. Cl. ..... 132/113; 132/112; 401/28; 222/192

[58] Field of Search ..... 132/112, 113, 132/114, 115, 116, 120, 313, 200, 207, 208; 401/28, 290, 282, 268; 222/192, 402.2, 402.13

[56] References Cited

U.S. PATENT DOCUMENTS

| | | | |
|---|---|---|---|
| 1,221,578 | 4/1917 | O'Connell | 132/113 |
| 1,570,013 | 1/1926 | Smith | 132/113 |
| 2,771,890 | 11/1956 | Jaberg | 132/112 |
| 2,897,826 | 8/1959 | Di Vito | 132/113 |
| 3,059,652 | 10/1962 | Thomas | 132/112 |
| 3,457,928 | 7/1969 | Kurshenoff | 132/113 |
| 3,463,170 | 8/1969 | McCullough | 132/113 |
| 4,090,522 | 5/1978 | Donley et al. | 132/112 |
| 4,229,116 | 10/1980 | Moore | 401/275 |
| 4,294,270 | 10/1981 | Cochran | 132/112 |
| 4,585,018 | 4/1986 | O'Connor | 132/120 |
| 5,297,882 | 3/1994 | Kornides | 132/112 |
| 5,325,878 | 7/1994 | McKay | 132/116 |
| 5,339,839 | 8/1994 | Forcelledo et al. | 132/114 |
| 5,343,880 | 9/1994 | McKay | 132/116 |

*Primary Examiner*—Gene Mancene
*Assistant Examiner*—Pedro Philogene
*Attorney, Agent, or Firm*—Jones, Tullar & Cooper, PC

[57] ABSTRACT

A device for dispensing fluid is provided which evenly applies fluid products to hair while the hair is being separated with the device. Combing is thereby facilitated and assisted by dispensing conditioner with the device. The device comprises a head, a plurality of teeth and a handle connected to the head. The teeth are removably attached to a front plate of the head. A shock absorber element provides an interface between a back plate of the head and the front plate. Flexibility of the front plate and removability of the teeth provide an improved combing/fluid dispensing device.

10 Claims, 2 Drawing Sheets

FLUID DISPENSING DEVICE

This invention is related to a combination liquid dispenser and brush and in particular to a device for use in applying hair conditioner.

BACKGROUND

In conventional methods of shampooing and conditioning hair, fluid is distributed from the container to the user's hand and then to the user's hair. A selected amount is applied to one area and subsequently spread over the rest of the hair.

There are a variety of hand-held combs that also apply liquid through the comb. In fluid application the difficult problem is to effectively distribute fluid to hair to promote rapid detangling and removal of matts.

U.S. Pat. No. 4,229,116 (Moore) discloses a combination brush and liquid soap dispenser which rotates to an open position. Moore does not permit controlled liquid dispensing; the rotary valve provides either an open or closed flow of fluid and is thereby not conducive to gradual dispensing of liquid with one hand on the brush. There is a need for a simplified tool for use with one hand to dispense fluid while combing hair. The device should not be any more difficult to operate than a standard comb or brush.

U.S. Pat. No, 4,294,270 (Cochran) discloses a fluid applicator. Although the applicator may be used with one hand, the teeth structure defined therein is stiff and does not permit movement of the surface attached to the teeth. Use of this applicator in instances when hair is not already combed and detangled would be difficult and painful and promote pulling of the hair. There is a need for an improved fluid dispensing tool which encourages easy separation of hair strands as fluid is dispensed thereto. In particular a shock absorbing surface attached to the teeth is desired to promote a forgiving brushing or combing of hair, while still facilitating the gradual dispensing of liquid through the teeth holes. There is also a need for fluid dispensing devices which are compatible with various uses. In particular, removable teeth have heretofore not been available.

SUMMARY OF THE INVENTION

The present invention utilizes an improved fluid dispensing tool to evenly apply fluid products, including hair conditioners and shampoos. The general purpose of the present invention is to provide a simple tool consisting of a head with two or more teeth and a handle attached to the head.

The head includes a first hollow compartment that connects with a second hollow compartment of the handle such that fluid stored in the handle may be delivered to the head and out through the teeth which are attached to one side of the head. The handle includes fluid delivery means for delivering fluid from the second to the first compartment. Removable stopper means contain fluid within the handle. The head is a multi-piece unit including a rigid back plate having a peripheral edge and a generally concave wall, a flexible or resilient gasket or shock absorbing element secured to the peripheral edge, and a rigid front plate that somewhat mirrors the back plate and is secured to the gasket.

The front plate carries the teeth. The back plate is connected to the handle. The teeth are hollow and have a plurality of holes extending therethrough, such that fluid delivered to the head is evenly distributed from the teeth through these holes. The teeth are removable from the head and may be replaced with different teeth selected by the user. A user may select longer teeth or teeth with holes of different sizes depending on various factors including the selected fluid or hair type. The fluid dispensing device of this invention thereby permits easy conditioning and shampooing of hair with a tool which has a simple design and is easy to manufacture.

DESCRIPTION OF THE PREFERRED EMBODIMENT

Figure 1:
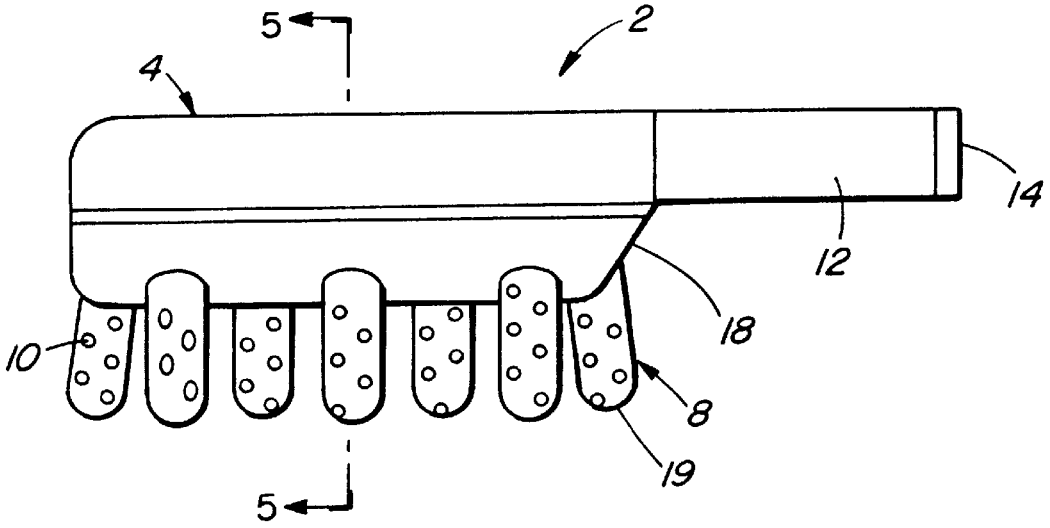
FIG. 1 is a perspective view of a fluid dispensing device illustrating the preferred embodiment of the invention.
Figure 4:
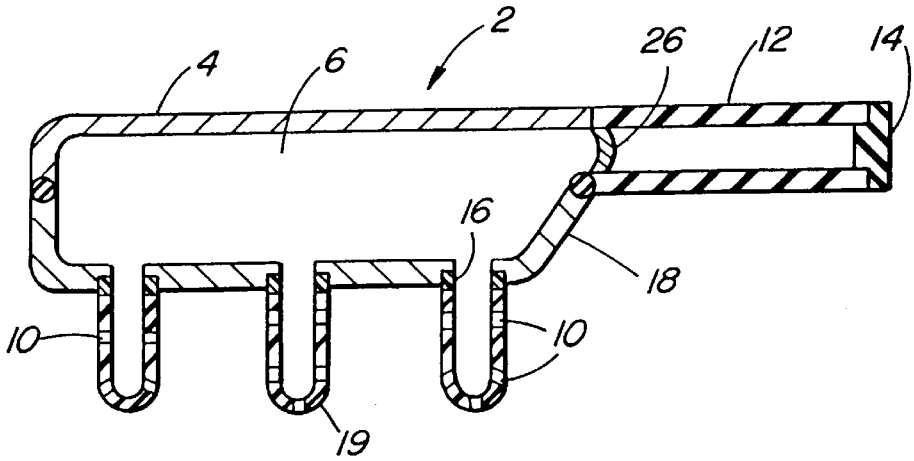
FIG. 4 is a longitudinal cross-sectional view through the device of FIG. 1.

FIGS. 1 and 4 illustrate a fluid dispensing device 2 comprising a head 4 which forms or defines a hollow compartment 6. A plurality of hollow teeth 8 are attached to the underside of the head. The teeth have a plurality of holes 10 extending therethrough and are in direct communication with the hollow compartment of the head. A handle 12 is provided with one end attached to the head and the other end closed with a removable cap 14.

Figure 3:
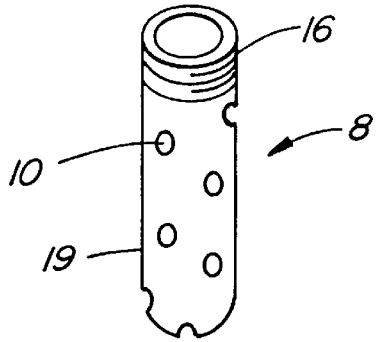
FIG. 3 is an enlarged view of a tooth of FIG. 1.

FIG. 3 illustrates a preferred tooth structure 8. The tooth wall has a plurality of holes 10 directed therethrough which facilitate even distribution of the fluid from the hollow compartment of the head. The tooth base 16 is attached to a front plate 18 of the head such that the tooth may be easily removed and interchanged with a tooth of different structure. Replacement teeth may have a different number or size of holes or be of varying rigidity or different lengths. In one embodiment each tooth has an external thread which may be screwed in and out of a threaded socket in the head. In another embodiment each tooth has a female end which fits over a hollow raised boss on the head. Such connections may be threaded or smooth. This connection maintains its integrity as fluid passes from the compartment of the head to the teeth and out through the plurality of holes. In one embodiment the tooth base is made of plastic and the body 19 of the teeth comprises rubber. The teeth are thereby flexible and work like fingers to avoid abrasion of the scalp upon contact.

Figure 5:
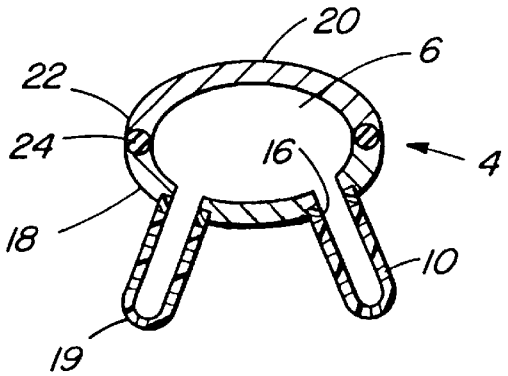
FIG. 5 is a cross-sectional view through lines 5—5 of FIG. 1.

As shown in FIGS. 4 and 5, the head includes a rigid concave back plate 20 having a peripheral edge 22, a flexible gasket or shock absorbing element 24 secured to the peripheral edge, and a rigid front plate secured to the gasket. The front plate carries the teeth. The shock absorbing element may be made of rubber and permits movement of the teeth. In particular, the element allows the rigid front plate to have some freedom of movement relative to the back plate. In preferred embodiments this layer is about ¼ inch wide. A check valve 26 may be located in the connection between the head and the handle. Fluid may be delivered from the compartment of the handle to the head compartment in a variety of ways. The handle may be constructed of a pliable material whereby the handle is squeezed by the user to deliver material to the head compartment and then out through the teeth holes. Alternatively, a pump mechanism may deliver material from the handle compartment to the head compartment.

Figure 2:
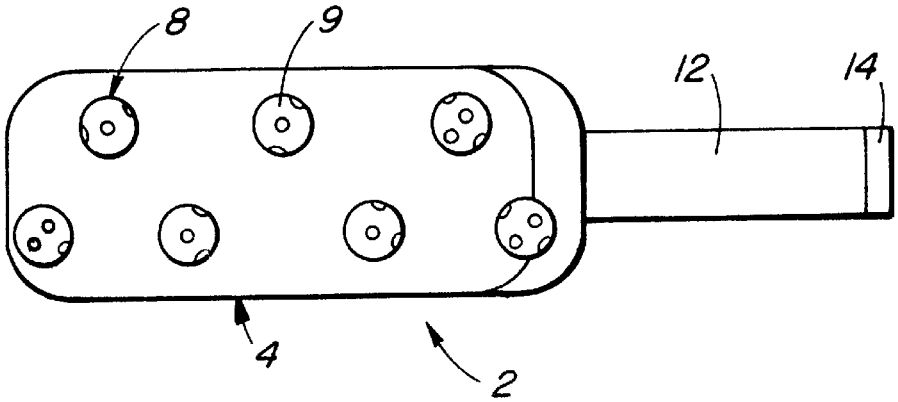
FIG. 2 is a bottom view of the device of FIG. 1.

In FIGS. 1 and 2 the teeth are positioned in an alternating pattern on the front plate of the head. The teeth may be normal to the front plate surface (as shown in FIGS. 4 and 5) or they may be at an acute angle to the normal to the surface.

The device in accordance with the present invention may also be used in hair colouring, tinting and similar procedures. The ability to customize the length of teeth and size of hole permits the user to modify the device according to the user's particular needs.

In preferred embodiments the teeth of the invention have six or more holes therethrough, permitting a more even distribution of fluid therefrom.

The subject invention also encompasses a method of dispensing fluid to human or animal hair using the fluid dispensing device of FIG. 1. A method of dispensing fluid and also combing hair using the device of FIG. 1 is also contemplated. A preferred method provides the device of the subject invention to dispense conditioner over human hair and comb the conditioner evenly through the hair, thereby facilitating effective detangling and removal of matts.

A method of dispensing and combing conditioner includes depositing a selected amount of conditioner in the handle and securing the cap attached thereto, then brushing the hair with the fluid dispensing device such that the teeth separate the hair strands. While brushing the hair a user may also squeeze the handle to dispense conditioner out of the perforated teeth. Liquid is thereby spread evenly out on the hair strands as the hair is combed. Conditioner may be selectively dispensed more heavily in particularly problem areas that prove difficult to comb through.

The shock absorbing element facilitates the combing and dispensing action by allowing gentle combing and spreading of teeth over the hair. This element promotes easy detangling with pain-free combing by allowing the front plate to bend about the edge of the back plate. The front plate may also be pushed or pulled toward or away from the back plate. The gasket also allows easier removal of the teeth from the hair. Increased mobility of the teeth as a result of the shock absorbing element does not translate into increased movement of the head, thereby allowing a steady, even dispensing of liquid notwithstanding any movement of the teeth as allowed by the shock absorber element.

The scope of the present invention is not intended to be limited by the embodiments provided herein but rather is defined by the following claims.

The embodiments of the invention in which an exclusive property or privilege is claimed are defined as follows:

1. A device for dispensing fluid comprising a head defining a first hollow compartment therein, the head including a back plate having a peripheral edge, a shock absorber element secured to the peripheral edge, a front plate secured to the shock absorber element;

a plurality of hollow teeth removably attached to the front plate, said teeth having a plurality of holes, the first hollow compartment being in fluid communication with the hollow teeth; and a handle connected to the head, said handle defining a second hollow compartment for fluid storage, a first end of the second hollow compartment being in fluid communication with the first hollow compartment, a second end of the second hollow compartment having a removable stopper means, said handle having fluid delivery means for delivering fluid from the second hollow compartment to the first hollow compartment.

2. The fluid dispensing device of claim 1, wherein the handle is constructed of pliable material such that fluid may be forced out of the second compartment into the first compartment by squeezing the handle.

3. The fluid dispensing device of claim 1, including pump means within said handle for pumping fluid from the second compartment into the first hollow compartment.

4. The fluid dispensing device of claim 1, wherein the teeth have six or more holes.

5. The fluid dispensing device of claim 1, wherein the shock absorber element comprises a layer of rubber.

6. The fluid dispensing device of claim 1, wherein each tooth has a female end and said head has a male portion such that the female end and the male portion are matingly engageable.

7. The fluid dispensing device of claim 1, wherein each tooth has a threaded end and the head has compatible threaded sockets such that the teeth may be screwed into the head or screwed out of the head and replaced.

8. The fluid dispensing device of claim 1, further including a second set of teeth of different lengths being used to replace a first set of teeth.

9. The fluid dispensing device of claim 1, further including a second set of teeth having holes of different sizes being used to replace a first set of teeth.

10. A method of dispensing conditioner over the hair of a human head comprising the steps of:

(a) introducing fluid conditioner into the second compartment of the device of claim 1;

(b) delivering fluid conditioner from the second compartment to the first compartment and out through the holes in the teeth using the fluid delivery means; and (c) moving the device along the hair to separate hair strands using the teeth while continuing to deliver fluid conditioner through the holes in the teeth, such that fluid conditioner is spread throughout the hair.

* * * * *